US006672867B1

(12) United States Patent
Du

(10) Patent No.: US 6,672,867 B1
(45) Date of Patent: Jan. 6, 2004

(54) STRUCTURE FOR FITTING CONTROL KNOBS AND A HANDLE ONTO A CONTROL PANEL OF AN OVEN

(76) Inventor: Amos Du, No. 13, Lane 155, Minsheng 12th St., Gueiren Shiang, Tainan Hsien (TW)

( * ) Notice: Subject to any disclaimer, the term of this patent is extended or adjusted under 35 U.S.C. 154(b) by 0 days.

(21) Appl. No.: 10/314,327

(22) Filed: Dec. 9, 2002

(51) Int. Cl.[7] ..... E05B 1/00

(52) U.S. Cl. ..... 432/250; 292/348; 126/198; 16/412

(58) Field of Search ..... 432/250, 251; 292/348; 16/412, DIG. 7, DIG. 32; 110/181; 126/273 R, 190, 192, 194, 198, 200

(56) References Cited

U.S. PATENT DOCUMENTS 4,382,175 A * 5/1983 Huggler ..... 219/413
5,632,062 A * 5/1997 Katz et al. ..... 16/412
5,740,587 A * 4/1998 Onai et al. ..... 16/412
6,050,177 A * 4/2000 Lassig, Jr. ..... 99/340
6,234,161 B1 * 5/2001 Levi et al. ..... 126/21 R

* cited by examiner

*Primary Examiner*—Gregory Wilson
(74) *Attorney, Agent, or Firm*—Birch, Stewart, Kolasch & Birch, LLP

(57) ABSTRACT

A structure for fitting a control knob and a handle onto a control panel of an oven of the present invention comprises a control panel, a plurality of positioning sets, at least a control knob and a handle, wherein the positioning sets function to insulate the control knob, the handle and the control panel from heat so that deformation of the control knob, the handle, and the control panel due to long duration heating operation of the oven can be effectively prevented. Thus, the use of heat insulation material for making the control knob and the handle can be effectively avoided, and therefore the manufacturing cost can be effectively reduced.

4 Claims, 8 Drawing Sheets

STRUCTURE FOR FITTING CONTROL KNOBS AND A HANDLE ONTO A CONTROL PANEL OF AN OVEN

BACKGROUND OF THE INVENTION

1. Field of the Invention

The present invention in general relates to an oven, and more particularly to a structure for fitting control knobs and a handle onto a control panel of an oven in manner to insulate the control knob and the handle of the oven from heat.

2. Description of the Related Art

The control knobs and the handle of a conventional oven are easily deformed due to heating. Further, the shape and the color of the control knobs and the handle are designed according to the oven and assembled onto the control panel of the oven. Following are some of the disadvantages of the conventional oven:

1. The control knobs easily get deformed and even gets damaged due to heating, and therefore the maintenance cost is high.
2. As the handle is directly assembled onto the control panel, therefore this would often pose high burn risk to the user during use.
3. The simple design of the control knob and the handle neither beautify the oven nor create attraction for the consumers to purchase the oven.

For improving the disadvantages described in 1 and 2 above, some have proposed to use control knobs and handle made of heat insulating material, but the surface of a heat insulating materials is usually rough and also the manufacturing cost is much higher, and therefore the cost for the consumers is accordingly higher.

SUMMARY OF THE INVENTION

Accordingly, it is an object of the present invention to provide a new structure for fitting control knobs and a handle onto a control panel of an oven in order to resolve the defects of the aforementioned prior art.

It is another object of the present invention to provide a structure for fitting control knobs and a-handle onto a control panel of an oven in a manner to insulate the control knobs and the handle from the heat of the oven, thus the deformation of the control knobs and the handle due to heating effects of the oven can be substantially reduced or eliminated.

It is another object of the present invention to provide a structure for fitting control knobs and a handle onto a control panel of an oven at no or little increase in the manufacturing cost.

In accordance with the above objects and other advantages of the present invention as broadly embodied and described herein, the present invention provides a structure for fitting control knobs and a handle onto a control panel of an oven comprising a control panel, a plurality positioning sets, at least a control knob and a handle, wherein the positioning sets function to insulate the control knobs, the handle and the control panel from heat.

According another aspect of the present invention, a simple structure with a variety of attractive shape and colored assembly parts for making the control knobs and the handle for fitting onto the control panel of the oven is provided such that the resultant outlook of the oven provides an attractive visional effect.

BRIEF DESCRIPTION OF THE DRAWINGS

For a more complete understanding of the present invention, reference will now be made to the following detailed description of preferred embodiments taken in conjunction with the accompanying drawings, in which.

DESCRIPTION OF THE PREFERRED EMBODIMENTS

Figure 1:
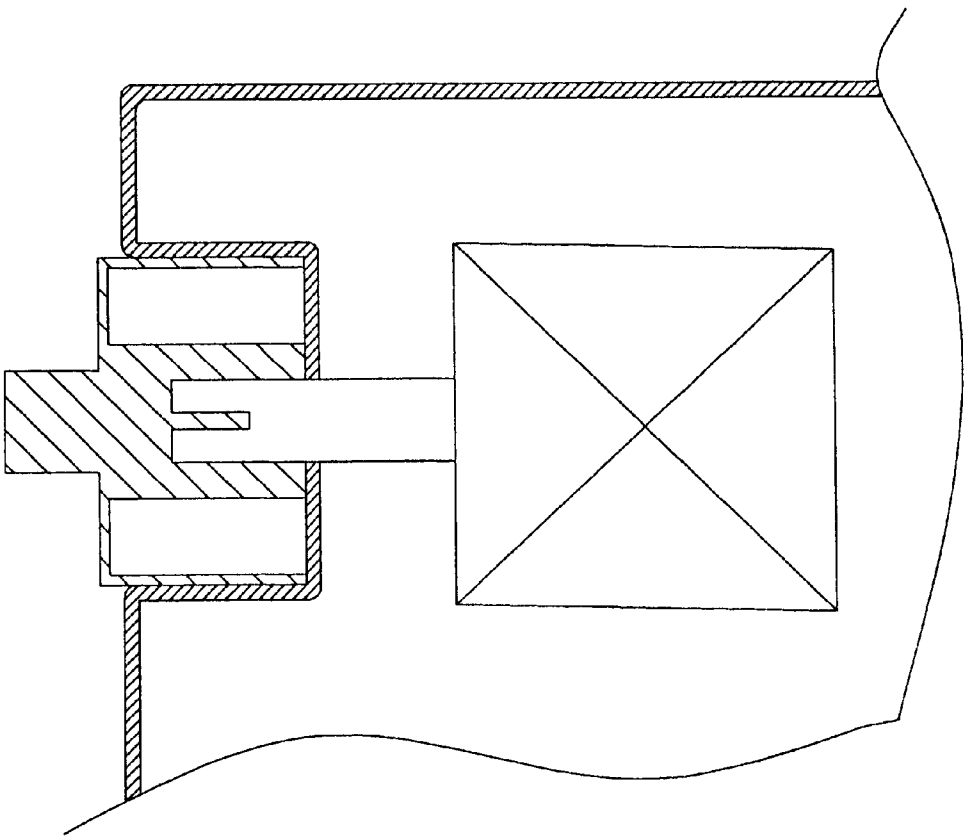
Fig. 1 PRIOR ART
FIG. 1 is a sectional view of the handle of the oven of a conventional oven.
Figure 2:
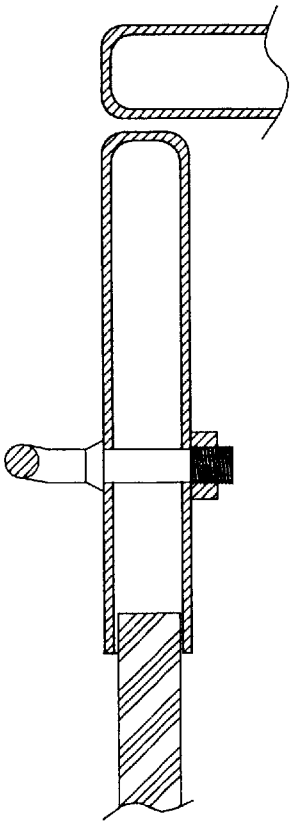
Fig. 2 PRIOR ART
FIG. 2 is a sectional view of the control knob of the oven of the conventional oven.

Reference will be made in detail to the preferred embodiments of the invention, examples of which are illustrated in the accompanying drawings. Wherever possible, the same reference numbers are used in the drawings and the description to refer to the same or like parts.

Figure 3:
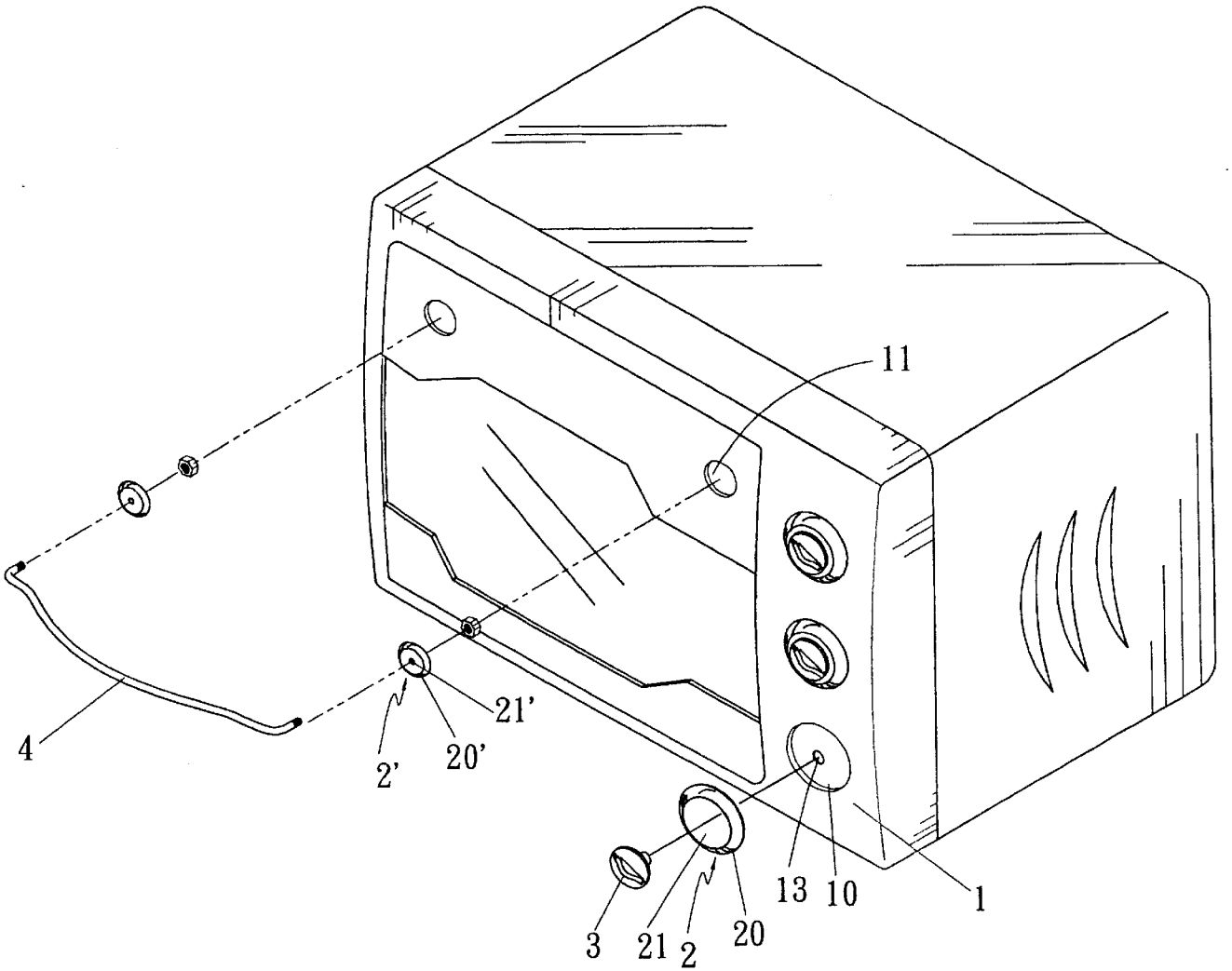
FIG. 3 is an exploded view of an oven according to a preferred embodiment of the present invention.
Figure 4A:
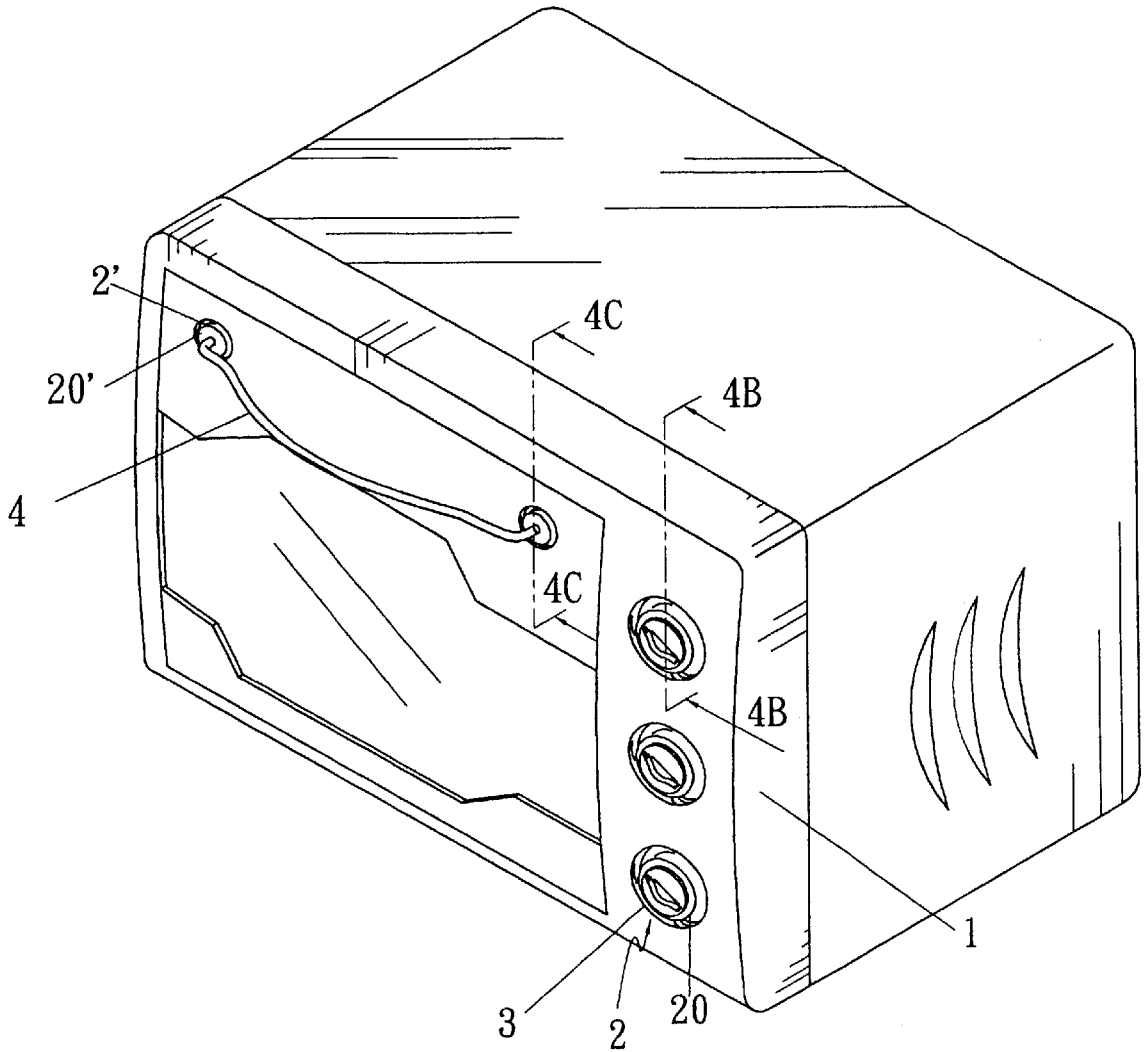
FIG. 4A is a elevation view of the oven of the present invention.

Referring to FIGS. 3 and 4A, the structure for fitting control knobs and a handle onto a control panel of an oven of the present invention comprises a control panel 1, a plurality of positioning sets 2 and 2', at least a control knob 3 and a handle 4, wherein the positioning sets 2 and 2' function to insulate the control knob 3, the handle 4 and the control panel 1 from heat so that deformation of the control knob 3, the handle 4, and the control panel 1 due to long duration heating operation of the oven can be effectively prevented. Further, the cost of using heat insulation material for manufacturing the control knob and the handle can be avoided to incur no extra cost or little increased cost.

The above-mentioned control panel 1 is a protruding arch-shaped structure having a plurality of grooves 10 and 11 are respectively disposed on a side portion and an upper portion of a front surface thereof. The grooves 10 that are disposed on the side portion of the front surface of the control panel 1 comprises an aperture 13 for assembling, for example, a thermostat 12, and the grooves 10 and 11 are inlayed with positioning sets 2 and 2'.

The positioning sets 2 and 2' comprise securing elements 20 and 20' respectively for firmly securing the positioning sets 2 and 2' within grooves 10 and 11. The securing elements 20 and 20' comprise apertures 21 and 21' for respectively fitting the control knob 3 and the handle 4.

Figure 4B:
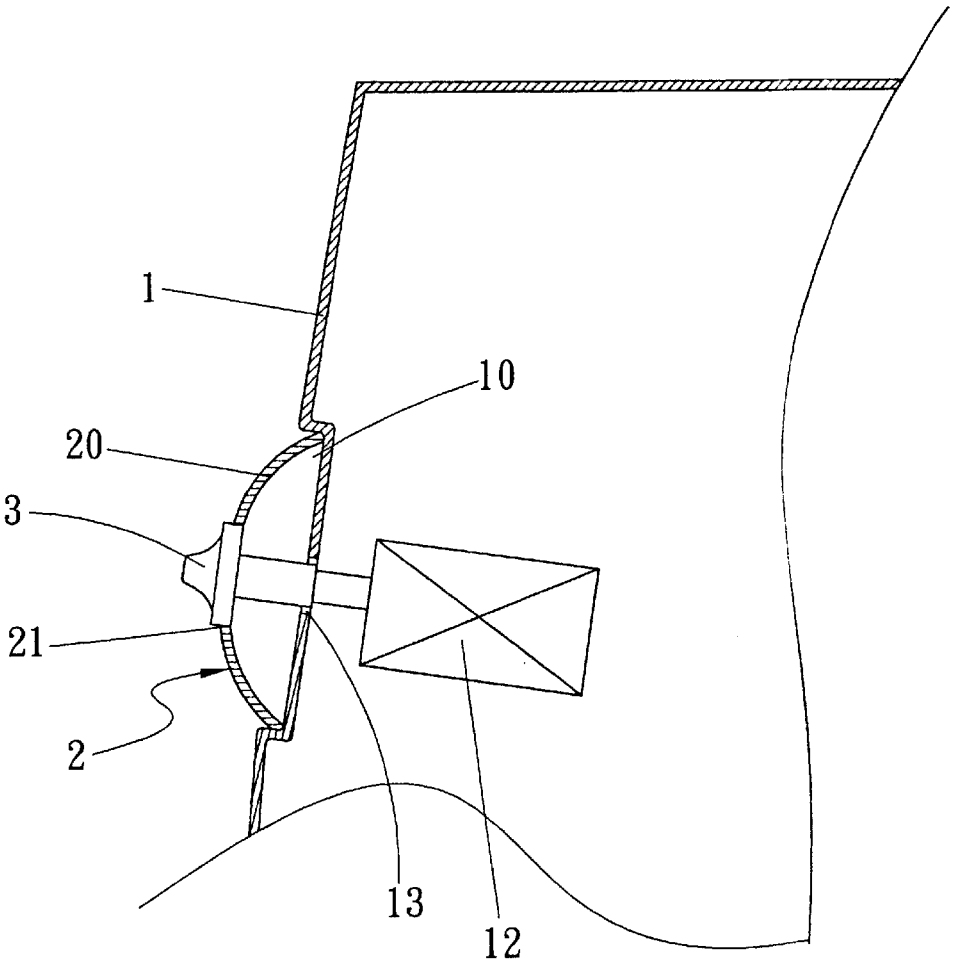
FIG. 4B is a sectional view taken along the line 4B—4B of FIG. 4A.
Figure 4C:
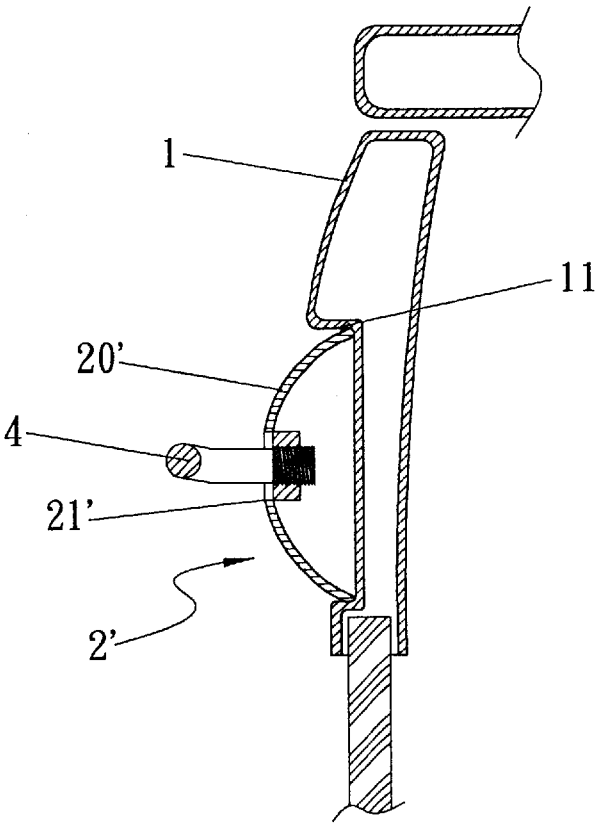
FIG. 4C is a sectional view taken along the 4C—4C of FIG. 4A.

Referring to FIGS. 4B and 4C, show the control knob 3 and the handle 4 fitted onto the positioning set 2 and 2', and the positioning set 2 and 2' are inlayed within the grooves 10 and 11 of the control panel 1. According to the present inventors, the arrangement will effectively insulate the control knob 3 and the handle 4 from heat to prevent the deformation of the control knob 3 and the handle 4 even when the oven is operated for a long duration to time. This is because, the positioning sets 2 and 2' have low heat conduction property therefore heat transfer from the interior of the oven to the control knob 3 and the handle 4 can be substantially reduced. Further, because the control knob 3 and the handle 4 need not be made of insulating material, and therefore the manufacturing cost can be reduced. Furthermore, the control panel 1, the control knob 3, and the handle 4 remain in good shape, and they can be manufactured using a variety of materials and designed to provide an attractive outlook to the oven and make it be more appealing to the consumer for purchasing the oven.

Figure 5:
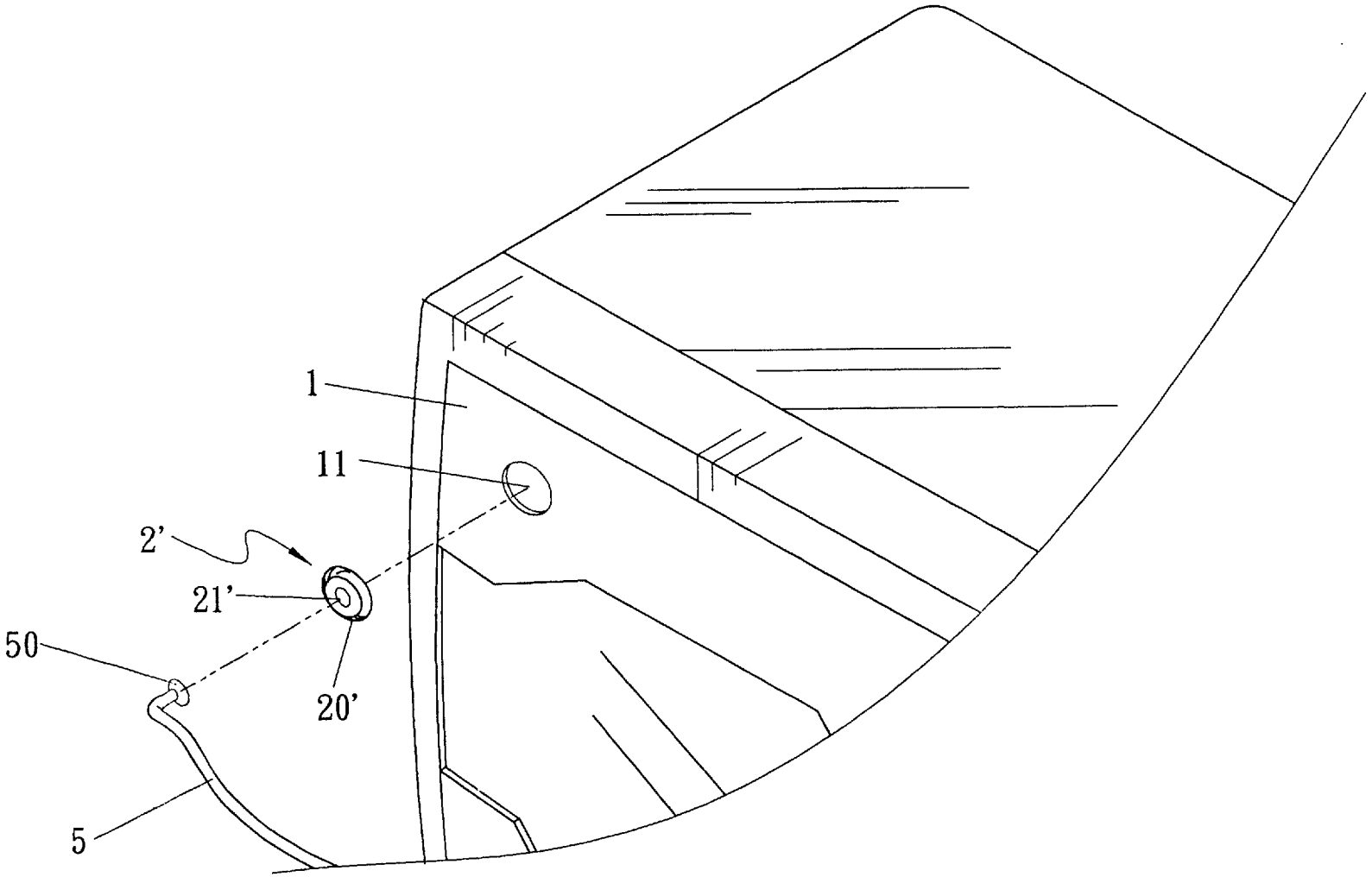
FIG. 5 is a sectional view of the handle of the oven according to another preferred embodiment of the present invention.
Figure 6:
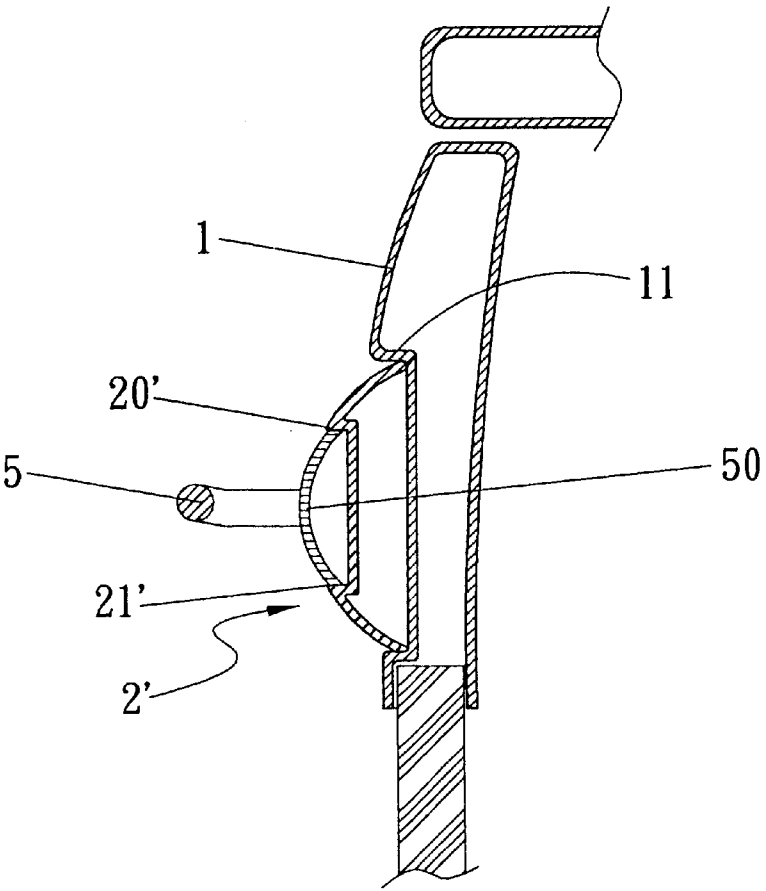
FIG. 6 is the sectional view of the handle of FIG. 5.

Referring to FIGS. 5 and 6, illustrates an oven according another preferred embodiment of the present invention which is similar to the FIG. 3, except for an additional one-piece buckling block 50 formed onto the positioning set 2' for fitting the two sides of the handle 5, and then the positioning set 2' is inlayed into the groove 11 of the control panel 1. This is designed to further beautify the handle and also this arrangement would further reduce the risk of damage due to heating operation of the oven.

While the invention has been described in conjunction with a specific best mode, it is to be understood that many alternatives, modifications, and variations will be apparent to those skilled in the art in light of the a foregoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

What is claimed is:

1. A structure for fitting a control knob and a handle on to a control panel of an oven, comprising:

a control panel having a protruded arch-shape structure, comprises a plurality of grooves disposed on a side portion and an upper portion of the front surface thereof, wherein at least one of the grooves that are disposed on said side portion comprises an aperture; and a plurality of positioning sets, each of the positioning sets comprises a securing element for securing within each of said grooves, wherein each groove comprises an aperture for securely fitting a control knob and an handle, and wherein the positioning sets function to insulate the control knob and the handle from a heat.

2. The structure for fitting a control knob and a handle on to a control panel of an oven according to claim 1, wherein the shape of the handle is formed as a flat or a curved structure.

3. The structure for fitting a control knob and a handle on to a control panel of an oven according to claim 1, wherein the handle comprises a buckling block disposed at two distal ends.

4. The structure for fitting a control knob and a handle on to a control panel of an oven according to claim 1, wherein the control knob and the handle have a shape and colors suiting a user's requirement.

* * * * *